US009014837B2

(12) United States Patent
Doukakis et al.

(10) Patent No.: US 9,014,837 B2
(45) Date of Patent: Apr. 21, 2015

(54) ATTACHMENT FOR EMBROIDERY AND SEWING MACHINES FOR CREATING CRYSTAL/RHINESTONE PATTERNS AND MOTIFS, AND SOFTWARE FUNCTIONS TO CONTROL THE ATTACHMENT

(76) Inventors: Ioannis Doukakis, Thermi (GR); Miltiadis Vasileiadis, Thermi (GR); Konstantinos Angelakis, Thermi (GR)

( * ) Notice: Subject to any disclaimer, the term of this patent is extended or adjusted under 35 U.S.C. 154(b) by 327 days.

(21) Appl. No.: 13/594,829

(22) Filed: Aug. 26, 2012

(65) Prior Publication Data

US 2013/0054000 A1 Feb. 28, 2013

Related U.S. Application Data

(60) Provisional application No. 61/527,994, filed on Aug. 26, 2011, provisional application No. 61/567,841, filed on Dec. 7, 2011.

(51) Int. Cl.

| | |
|---|---|
| ***G06F 7/66*** | (2006.01) |
| ***D05C 7/04*** | (2006.01) |
| ***D05B 37/00*** | (2006.01) |

(52) U.S. Cl.

CPC . *D05C 7/04* (2013.01); *D05B 37/00* (2013.01)

(58) Field of Classification Search

CPC ..... D05C 7/04; D05C 7/08; D05B 3/12; D05D 2303/12; D05D 2303/18

USPC ..... 700/136–138, 134; 112/110, 115, 104, 112/475.01, 475.14, 475.15

See application file for complete search history.

(56) References Cited

U.S. PATENT DOCUMENTS

| | | | | |
|---|---|---|---|---|
| 4,623,411 | A * | 11/1986 | Pollak et al. | 156/93 |
| 6,971,325 | B1 * | 12/2005 | Inaba | 112/475.19 |
| 8,276,532 | B2 * | 10/2012 | Kawaguchi | 112/470.05 |
| 8,336,214 | B2 * | 12/2012 | Kawaguchi et al. | 33/18.1 |
| 8,656,850 | B2 * | 2/2014 | Kawaguchi et al. | 112/470.06 |
| 8,671,860 | B2 * | 3/2014 | Kawaguchi et al. | 112/475.05 |
| 8,733,263 | B2 * | 5/2014 | Kawaguchi et al. | 112/470.06 |
| 2006/0011116 | A1 * | 1/2006 | Tajima et al. | 112/113 |
| 2006/0048689 | A1 * | 3/2006 | Billert | 112/78 |
| 2006/0254484 | A1 * | 11/2006 | Tajima et al. | 112/2 |
| 2007/0119357 | A1 * | 5/2007 | Tajima | 112/104 |
| 2008/0087206 | A1 * | 4/2008 | Murase | 112/106 |
| 2009/0107373 | A1 * | 4/2009 | Niizeki | 112/102.5 |

OTHER PUBLICATIONS

U.S. Appl. No. 10/962,061, filed Apr. 14, 2005, Thomas Buffum.

* cited by examiner

*Primary Examiner* — Nathan Durham
(74) *Attorney, Agent, or Firm* — John Alumit

(57) ABSTRACT

Method for creating a crystal/rhinestone template utilizing a sewing/embroidery machine to perforate a medium in a desired pattern. In the case of a multiple-needle sewing/embroidery machine, the machine's needle is replaced by a perforator blade and perforator blade holder which are attached to machine's needle bar. Machine's needle plate is replaced by perforator plate and waste holder. With a single-needle sewing/embroidery machine, machine's needle is replaced by a pressing tool attached to the machine's needle bar. A contact point, a spring, and an arm are attached to machine's presser foot. Machine's needle plate is replaced by perforator plate. A template medium is placed on a work surface of machine. Machine is operated by software that reads a user-specified pattern/motif outline for filling stones in vector form, using innate rules to move machine frame and control hole placement.

20 Claims, 6 Drawing Sheets

ATTACHMENT FOR EMBROIDERY AND SEWING MACHINES FOR CREATING CRYSTAL/RHINESTONE PATTERNS AND MOTIFS, AND SOFTWARE FUNCTIONS TO CONTROL THE ATTACHMENT

CROSS-REFERENCE TO RELATED APPLICATION

This present application claims the benefit of Provisional Application No. 61/527,994 filed Aug. 26, 2011 and Provisional Application No. 61/567,841 filed Dec. 7, 2011. The prior applications are incorporated herein by reference.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

This application is directed to a system for creating a template to be filled with crystals or rhinestones. Crystals and rhinestones ("stones") are used for embellishment or decorative purposes, often in the form of a pattern or motif. To accurately and consistently affix the stones to items such as a garment, a template with the desired pattern or motif, it is advantageous to affixing each stone by hand or creating a new template with each placement of the stones.

Information relevant to attempts to address these problems can be found in U.S. patent application Ser. No. 10/962,061. However, this reference suffers from one or more of the following disadvantages: the user must determine placement of the rhinestones onto a grid board to create the desired pattern or motif; with each use of the invention, the pattern or motif must be re-created.

For the foregoing reasons, there is a need for a system to create a crystal/rhinestone template utilizing a sewing or embroidery machine attachment to create holes or perforate a medium in the desired pattern and a computer software application/function ("software") to control the sewing/embroidery machine ("machine").

SUMMARY

The present invention is directed to a system that satisfies the need to create a crystal/rhinestone template using a sewing or embroidery machine. The invention comprises attachments for multi-needle and single-needle machines and computer software to control the machine.

The attachment is used with a machine needle bar and includes a perforator blade, perforator blade holder, and needle/perforator plate and waste holder. The perforator blade makes holes/perforates through a template medium placed on the machine's work surface in a desired pattern or motif. The template can later be filled with crystals or rhinestones. On single-needle machines, there is also a pressing tool, contact point, spring, and arm. The machine is controlled with software that is part of the overall software program.

The software is used to move the machine frame and control hole placement. The software application (i) moves the machine frame in X and Y coordinates, and instructs the needle bar motor to move the needle bar up and down to create the holes in the crystal/rhinestone pattern/motif; (ii) uses special (innate) rules to adjust pressure to create the desired hole size according to the medium being used; (iii) uses special (innate) rules to distribute the holes evenly on the intended motif and/or create certain pattern(s) with holes (iv) uses special (innate) rules to ensure there are no overlapping holes in a pattern/motif, and (v) uses special (innate) rules to ensure that only whole holes are made and that no hole is placed outside the pattern/motif contour.

DRAWINGS

These and other features, aspects, and advantages of the present invention will become better understood with regard to the following description, appended claims, and accompanying drawings.

The invention does not require that all the advantageous features and all the advantages need to be incorporated into every embodiment of the invention.

DESCRIPTION

Figure 1:
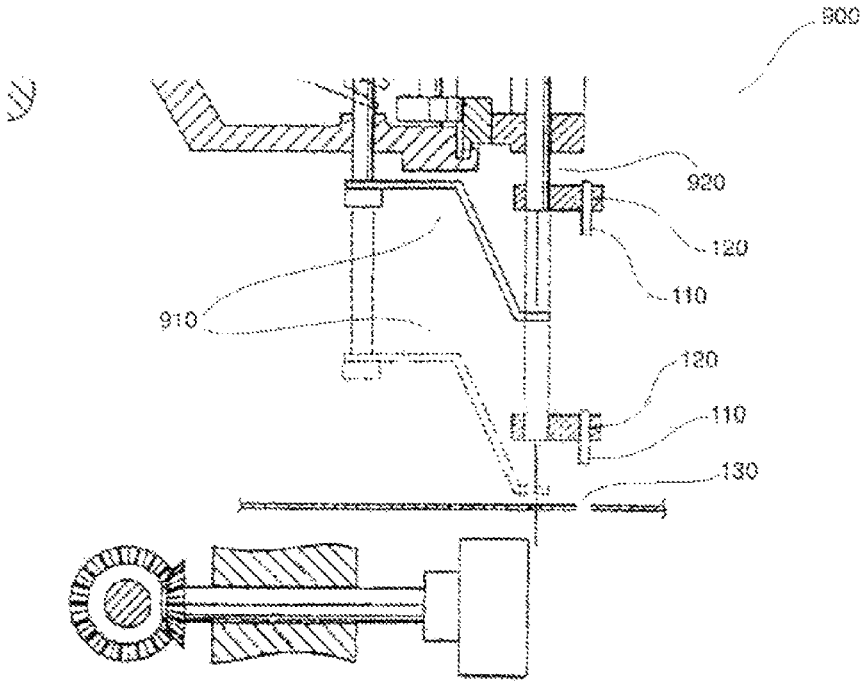
FIG. 1 illustrates a multi-needle sewing/embroidery machine head in profile view with the attached invention.

Referring to FIG. 1, a multiple-needle sewing/embroidery machine head is illustrated with an embodiment of the present invention attached for multi-needle machines. The machine 900 is shown with the presser foot 910 and needle bar 920 in the up and down position. This embodiment of the present invention comprises a "perforator blade" 110, a "perforator blade holder" 120, and a "needle/perforator plate and waste holder" 130. The perforator blade 110 and perforator blade holder 120 is attached to the machine's needle bar 920 and replaces the machine's needle. The needle/perforator plate and waste holder 130 replaces the machine's needle plate.

Figure 11:
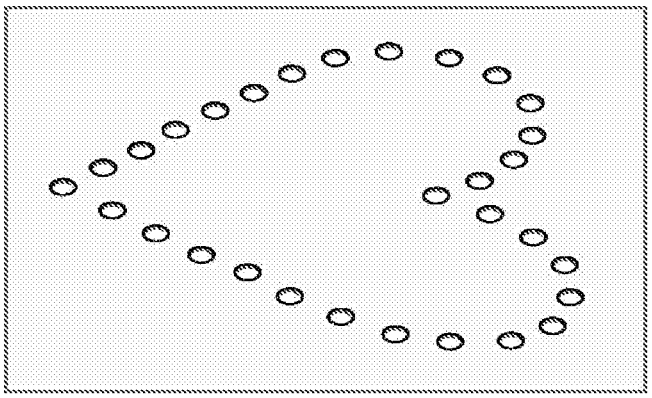
FIG. 11 illustrates a perspective view of the finished template.

When the machine 900 is run in conjunction with the design/pattern created by the software application, the perforator blade 110 and perforator blade holder 120 move up and down with the needle bar 920 and presser foot 910. As the perforator blade 110 moves down (shown in broken lines), it passes through the work surface into the needle/perforator plate and waste holder 130. When a template medium (FIG. 11) is placed on the work surface, the perforator blade 110 makes holes or perforations through the template medium. As the machine 900 carries out the commands from the software, the desired pattern/motif is created on the template medium (FIG. 11).

Figure 2:
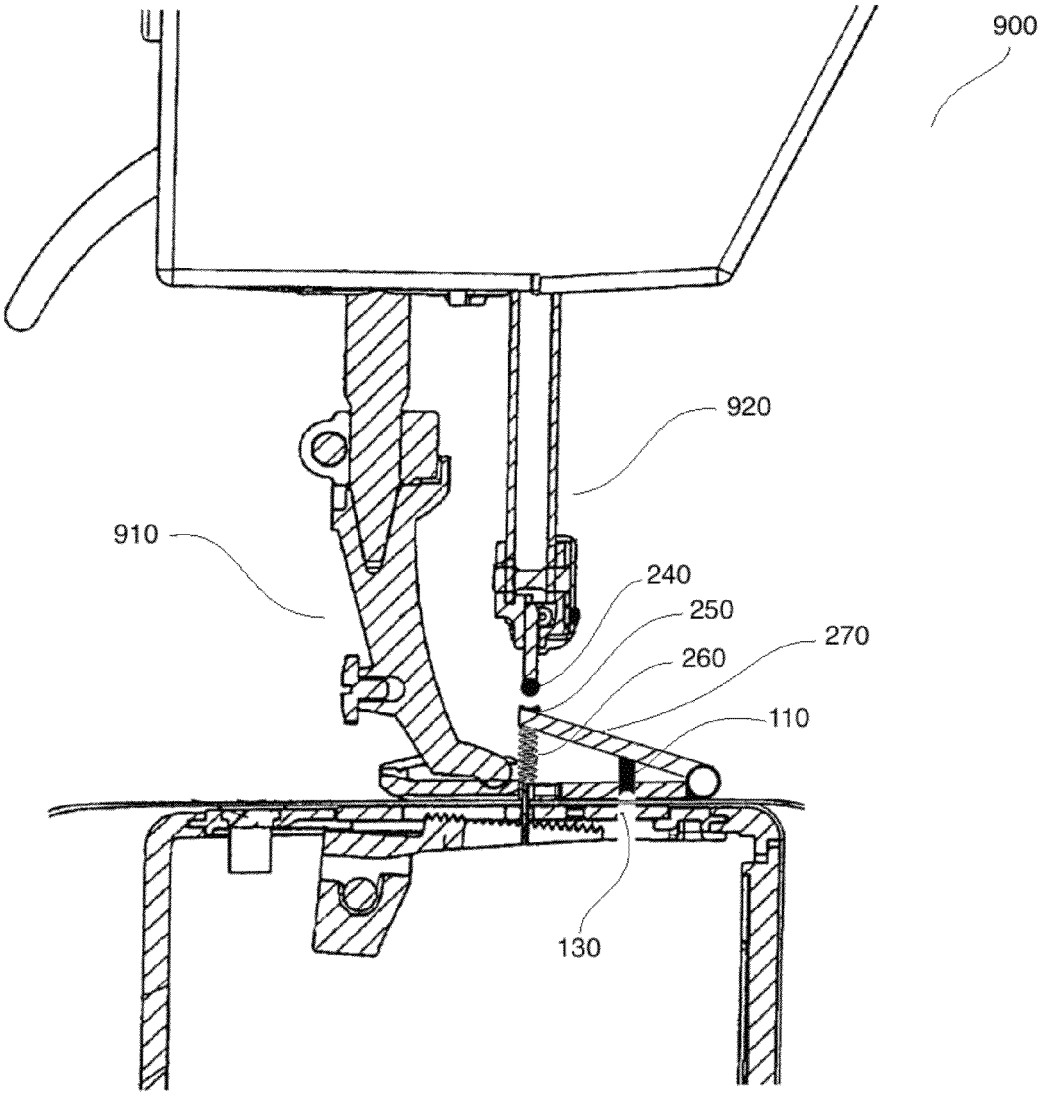
FIG. 2 illustrates a single-needle sewing/embroidery machine head in profile view with the attached invention.

Referring to FIG. 2, a single-needle sewing/embroidery machine head is illustrated with an embodiment of the present invention attached for single-needle sewing/embroidery machines. The machine 900 is shown with the presser foot 910 and needle bar 920 in the up position. This embodiment of the present invention comprises a perforator blade 110, needle/perforator plate and waste holder 130, a pressing tool 240, a contact point 250, a spring 260, and an arm 270. The pressing tool 240 is attached to the machine's needle bar 920 instead of the machine's needle. The contact point 250, spring 260, and arm 270 are used as an attachment to the presser foot 910 of the machine 900. The needle/perforator plate and waste holder 130 replaces the machine's needle plate.

Once again, when the machine 900 is run in conjunction with the design/pattern created by the software, the needle bar 920 and pressing tool 240 press the contact point 250 downward. As the contact point 250 moves down, the arm 270 and perforator blade 110 also move downward through the work surface into the needle/perforator plate and waste holder 130. As the machine carries out the commands from the software with a template medium (FIG. 11) on the work surface, a template is created for crystals/rhinestones in the desired pattern/motif (FIG. 11).

Figure 3:
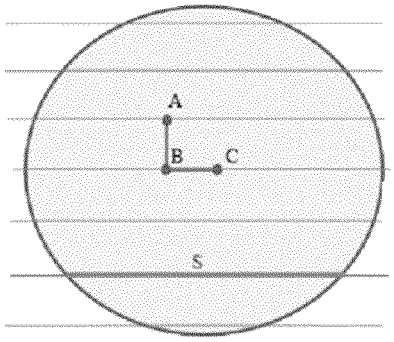
FIG. 3 illustrates an example of a circle pattern/motif outline which a software reads and which will be filled with stones in vector form.

To carry out use of the invention, there is a need for a software application. The software first reads a user-specified pattern/motif outline for stones in vector form. FIG. 3 illustrates the selection of a circle pattern/motif outline. The outline is a closed shape created using Bezier $3^{rd}$ degree curves and line segments. A technique to fill the pattern is then selected by the user, as well as the shape and size of the stones to be used. Depending on the user-selected technique to fill the pattern, the software may request extra values from the user, such as distance and/or points on the pattern where stones are required to be placed.

The software then instructs the user to select a proper size die set of perforator blade 110 and needle/perforator plate and waste holder 130, optionally with a size 0.4 mm or larger in diameter than the size of the stones to be used. To prevent the template medium (FIG. 11) from easily tearing, a "minimum spacing of stones" (MSS) is determined. This distance varies with stone size (i.e. larger stones need larger safety distances) and is approximately 0.4 mm for the usual SS10 (2.7 m) stone size. The actual values are set as a look-up-table (LUT) inside the software application for each die size supplied to the user.

Next, the software determines the placement of each stone on the pattern according to the user-selected technique. These techniques include: outline shape, rectangle fill, circular fill, contour fill, shape fit fill, single line, and line fit.

Figure 4:
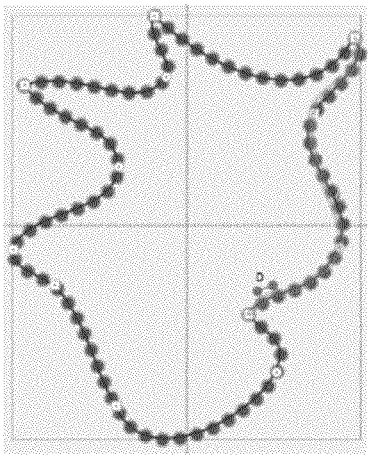
FIG. 4 illustrates an example of the outline shape technique to determine stone placement.

Referring to FIG. 4, the outline shape technique is illustrated. With the outline shape technique, stones are placed along the outline of a closed or open shape. The software reads the distance between stones (D) from the user. If D is less than the MSS calculated earlier, the MSS is used instead. "Corner points" along the outline are determined. The segments (Bezier/Line) between the corners are gathered by the software into open polylines (P). The length of each open polyline (L) is calculated and then divided by the distance (D), the resulting number (N) is truncated towards zero (e.g. if N is 3.6 it is rounded to 3, not 4). The polyline (P) is divided into N segments and one stone is placed at the start and one at each of the N division point(s). If a particular polyline (P) is the last one and the shape is open, the software places a stone at the end of the polyline. The software remembers each stone already placed and does not place an additional stone that overlaps with a previous one, which may otherwise happen on sharp corners.

Figure 5:
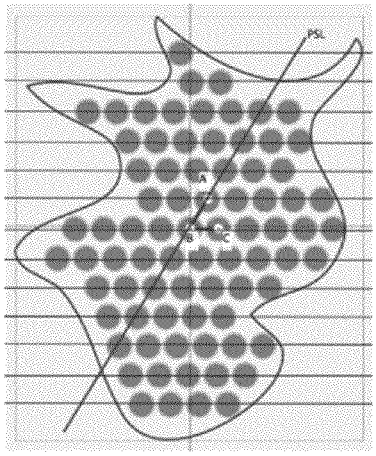
FIG. 5 illustrates an example of the rectangle fill technique to determine stone placement.

Referring to FIG. 5, the rectangle fill technique is illustrated. With the rectangle fill technique, stones are placed within the shape along parallel lines. The software reads three points from the user (A, B, C) which define the requested spacing between stones (points B-C), requested spacing between lines (points A-B) and requested angle (lines A-B, B-C). The line segment A-B cannot be parallel to line segment B-C. If either the spacing between stones (SS), or the spacing between lines (SL) is less than MSS, the MSS is used instead. The software calculates a line (PSL) which is parallel to A-B. A series of horizontal lines, parallel to line B-C, which cover the entire shape is then calculated with a spacing of SL. Starting from the intersection of each parallel line with PSL, stones are placed at a regular distance of SS to the left and right of the intersection point within the shape.

Figure 6:
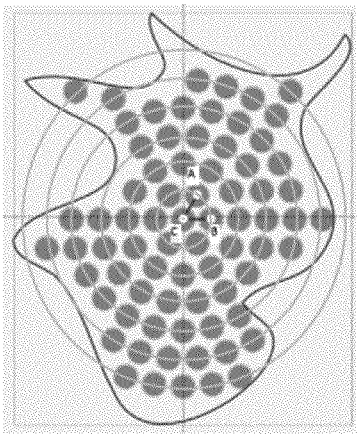
FIG. 6 illustrates an example of the circular fill technique to determine stone placement.

Referring to FIG. 6, the circular fill technique is illustrated. With the circular fill technique, stones are placed within the shape along parallel circular lines radiating from a center point. The software reads three points from the user (A, B, C). The center point is represented by point C, the spacing between stones (SS) is determined from the distance A-B, and the spacing between circles (SC) is determined from the equal distances A-C and B-C. Point A also defines the point where the software starts dividing the circles. If the spacing between stones (SS) or spacing between circles (SC) is less than MSS, the MSS is used instead. The software places one stone at center point (C) and calculates circles with a radius increasing by SC until there is a circle that fully contains the input shape. For each circle, the software divides the circle into even segments with a length of SS and outputs one stone at each division point along the circle, if the point/stone is within the shape.

Figure 7:
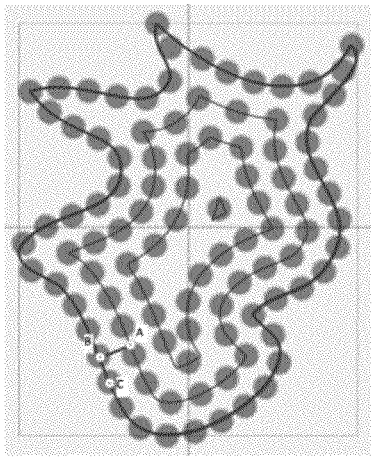
FIG. 7 illustrates an example of the contour fill technique to determine stone placement.

Referring to FIG. 7, the contour fill technique is illustrated. With the contour fill technique, stones are placed along the outline of the shape and along curves that match the outline of the shape in decreasing size. Once again, the software reads three points from the user (A, B, C). Line A-B is perpendicular to line B-C. Distance B-C defines the spacing between stones (SS) and distance A-B defines the spacing between curves (SC). If either the SS or SC is less than MSS, the MSS is used instead. The software then fills the original outline with stones at a distance of SS using the outline shape technique previously described. Next, a new shape is calculated which is smaller than the original outline. The curves of the new smaller shape are created in such a way that each point in the new shape has an exact distance of SC from the original point in the original outline. If the new shape is less than one stone in size, the software outputs one stone at the center and the whole technique process ends. Otherwise, the software repeats the technique process with the next smaller shape.

Figure 8:
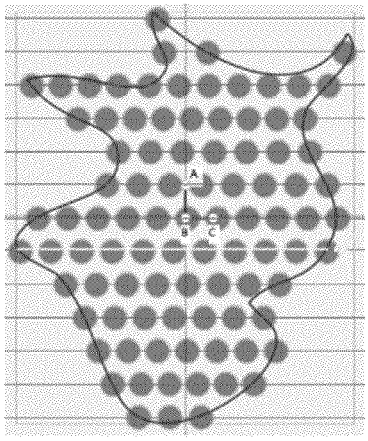
FIG. 8 illustrates an example of the shape fit fill technique to determine stone placement.

Referring to FIG. 8, the shape fit fill technique is illustrated. With the shape fit method to fill technique, the software reads points A, B, and C from the user. The spacing between stones (SS) is determined from points B-C and the spacing between lines of stones (SL) is determined from points A-B. Line segment A-B is perpendicular to line segment B-C. If either the SS or SL is less than MSS, the MSS is used instead. The software calculates a series of lines parallel to B-C, with spacing between lines of SL, which cover the entire shape. For each of the parallel lines, the intersection between the line and pattern/motif outline is determined (segment S). The software divides the length of segment S by SS, rounding the result (N) towards zero. This number (N) is the number of stones that can fill that segment S. The software splits the segment S into N equal pieces, puts one stone at the beginning and end, and stones at each division point.

Figure 9A:
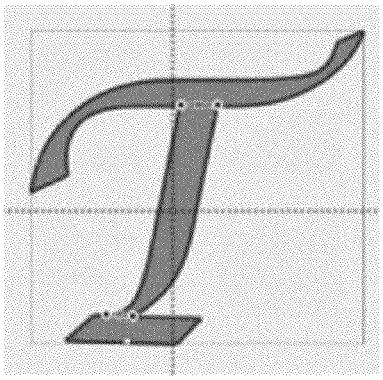
FIG. 9A illustrates how the software splits each letter into original strokes used to create the letter.
Figure 9B:
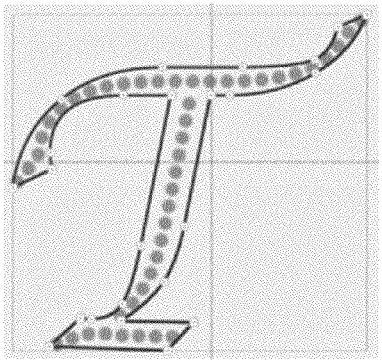
FIG. 9B illustrates an example of the single line fill technique to determine stone placement.

Referring to FIGS. 9A-9B, the single line technique for text is illustrated. With this technique, the software reads the user-specified distance between stones (D). If D is less than MSS, the MSS is used instead. The original strokes used to make the particular letter are determined, and a center path line is calculated for each stroke. In FIG. 9A, the software has split the calligraphic letter "T" into three strokes. Once the center path line for each stroke is determined, stones are filled along the line using the outline technique explained earlier, as best illustrated in FIG. 9B.

Figure 10:
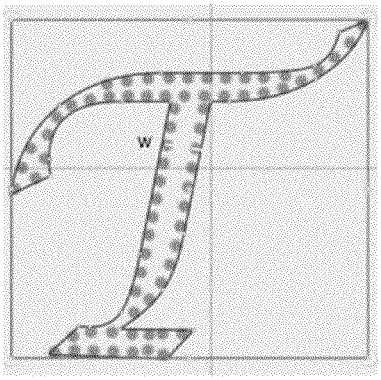
FIG. 10 illustrates an example of the line fit technique to determine stone placement.

Another technique used for text is line fit, as illustrated in FIG. 10. With the line fit technique, the software also reads the user-specified distance between stones (D). If D is less than MSS, the MSS is used instead. As illustrated in FIG. 9A the original strokes used to make the particular letter are determined, and a center path line is calculated for each stroke. The software then places stones across the center path of the stroke. If the width of the stroke exceeds 2×D, more than one stone may be placed. Referring to FIG. 10, the number of stones output is the width of the stroke at that point (W), divided by D and rounded towards zero.

After calculating the stones for all the shapes in the design, the stones are grouped together first by size and then by color, so as to make one template for each size and color. Special (innate) rules are used to ensure that only whole holes are made and that no hole is places outside the pattern/motif contour.

As illustrated in FIGS. 4-10, the software outputs the stone coordinates into an embroidery file format, which then contains the coordinates of each stone, plus special instructions when there is a need for the user to remove the template medium (FIG. 11) and put in a new template medium to create the next template.

The machine uses the data in the file to drive its machine frame in X and Y coordinates, and instructs the needle bar motor to move the needle bar up and down to create the holes that make the stone patterns/motifs. Special (innate) rules are used to adjust pressure to create the desired hole size according to the medium being used.

All features disclosed in this specification, including any accompanying claim, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed:

1. A method for creating a crystal/rhinestone template utilizing a sewing or embroidery machine to perforate a medium in a desired pattern for a multiple-needle sewing or embroidery machine, comprising the steps of:

replacing the multiple-needle sewing or embroidery machine's needle by attaching a perforator blade and a perforator blade holder to a needle bar of said machine, and replacing a needle plate of the machine with a perforator plate and waste holder;

placing a template medium on a work surface of the machine; and operating the machine using software that reads a user-specified pattern or motif outline for filling stones in vector form.

2. The method of claim 1, wherein the outline is a closed shape created using Bezier $3^{rd}$ degree curves and line segments.

3. The method of claim 2, wherein the software allows a user to select a technique to fill the shape, as well as angle and spacing of the stones, and size of the stones to be used.

4. The method of claim 3, wherein the software allows the user to select a proper size die set, preferably with a size 0.4 mm or larger in diameter than the size of the stones to be used.

5. The method of claim 1, wherein the software comprises a look-up-table for each die set size for a user to set a minimum safety distance between adjacent holes to prevent the template medium from easily tearing.

6. The method of claim 1, wherein the software determines placement of each stone on a pattern according to a user-selected technique, including outline shape, rectangle fill, circular fill, contour fill, shape fit fill, single line, and line fit.

7. The method of claim 6, wherein, when using an outline shape technique wherein a user places stones along an outline of a closed or open shape, the software performs the following steps:

reads the distance between stones (D), if D is less than a minimum spacing of stones (MSS) calculated earlier, sets the MSS as the distance between stones, determines "Corner points" along the outline, gathers Bezier Line segments between corners into open polylines (P), calculates the length of each open polyline (L) and divides by the distance (D), the resulting number (N) is truncated towards zero, divides the polyline (P) into N segments and places one stone at a starting point and one at each of N division point(s); if a particular polyline (P) is the last one and the shape is open, the software places a stone at the end of the polyline; and the software remembers each stone already placed and does not place an additional stone that overlaps with a previous one.

8. The method of claim 6, wherein, when using a rectangle fill technique where stones are places within a shape along parallel lines, the software performs the following steps:

reads three points (A, B, C) set by user which define a requested spacing between stones (points B-C), requested spacing between lines (points A-B) and requested angle (lines A-B, B-C); the line segment A-B cannot be parallel to line segment B-C;

If either the spacing between stones (SS), or the spacing between lines (SL) is less than a minimum spacing of stones (MSS), the MSS is used as the SS or SL;

calculates a line (PSL) which is parallel to A-B;

calculates a series of horizontal lines, parallel to line B-C, which cover the entire shape with a spacing of SL; and places stones, starting from an intersection of each parallel line with PSL, at a regular distance of SS to the left and right of an intersection point within the shape.

9. The method of claim 6, wherein, when the circular fill technique is used where stones are placed within a shape along parallel circular lines radiating from a center point; the software performs the following steps:

reads three points (A, B, C) set by a user, where the center point is represented by point C, the spacing between stones (SS) is determined from a distance A-B, and the spacing between circles (SC) is determined from an equal distances A-C and B-C; Point A also defines the point where the software starts dividing the circles;

if the spacing between stones (SS) or spacing between circles (SC) is less than a minimum spacing of stones (MSS), sets the MSS as the SS or SC;

places one stone at center point (C) and calculates circles with a radius increasing by SC until there is a circle that fully contains a shape input by the user; and for each circle, the divides the circle into even segments with a length of SS and outputs one stone at each division point along the circle where the point/stone is within the shape.

10. The method of claim 6, wherein, when the contour fill technique is used where stones are placed along an outline of a shape and along curves that match an outline of a shape in decreasing size; the software performs the following steps:

reads three points from a user (A, B, C); Line A-B is perpendicular to line B-C; Distance B-C defines the spacing between stones (SS) and distance A-B defines the spacing between curves (SC);

if either the SS or SC is less than a minimum spacing of stones (MSS), sets the MSS as the SS or SC;

fills the outline with stones at a distance of SS using an outline shape technique;

calculates a new shape which is smaller than the outline;

creates curves of the new smaller shape in such a way that each point in the new smaller shape has an exact distance of SC from an original point in the outline; and if the new shape is less than one stone in size, outputs one stone at the center and ends the method; otherwise, the software repeats the method with a next smaller shape.

11. The method of claim 6, wherein, when the shape fit fill technique is used where a user inputs an outline of a shape and sets points A, B, and C, the software performs the following steps:

determines the spacing between stones (SS) from points B-C and determines the spacing between lines of stones (SL) from points A-B; line segment A-B is perpendicular to line segment B-C;

if either the SS or SL is less than a minimum spacing of stones (MSS), sets the MSS as the SS or SL;

calculates a series of lines parallel to B-C, with spacing between lines of SL, which cover the shape;

for each set of parallel lines, determines an intersection (segment S) between the line and outline;

divides a length of segment S by SS, rounding the result (N) towards zero which is the number (N) of stones that can fill that segment S; and splits the segment S into N equal pieces, putting one stone at beginning and end, and stones at each point of division.

12. The method of claim 6, wherein, when the single line technique the software performs the following steps:

reads a user-specified distance between stones (D);

if D is less than a minimum spacing of stones (MSS), sets the MSS as D;

determines original strokes used to make a particular letter, and calculates a center path line for each stroke;

once the center path line for each stroke is determined, fills stones along a line using an outline technique.

13. The method of claim 6, wherein, when the fit line technique is used, the software performs the following steps:

reads a user-specified distance between stones (D);

if D is less than a minimum spacing of stones (MSS), sets the MSS as D;

determines original strokes used to make a particular letter, and calculates a center path line for each stroke;

places stones across a center path of a stroke;

if a width of the stroke exceeds 2×D, more than one stone may be placed; and the number of stones output equals the width of the stroke at a point (W), divided by D and rounded towards zero.

14. The method of claim 6, wherein after calculating the stones for all the shapes in the design, the stones are grouped together first by size and then by color, so as to make one template for each size and color.

15. The method of claim 14, wherein, the software outputs stone coordinates into an embroidery file format, which then contains the coordinates of each stone, plus special instructions when there is a need for the user to remove the template medium and put in a new template medium to create the next template.

16. The method of claim 1, wherein the machine uses data in a file to drive its machine frame in X and Y coordinates, and instructs a motor of the needle bar to move the needle bar up and down to create holes that make a stone patterns/motifs.

17. The method of claim 1, wherein the software comprises special, innate rules to adjust pressure to create a desired hole size according to the medium used.

18. The method of claim 1, wherein the software comprises special, innate rules used to ensure that only whole holes are made and that no hole is placed outside a pattern/motif contour.

19. A method for creating a crystal/rhinestone template utilizing a sewing or embroidery machine to perforate a medium in a desired pattern for a single-needle sewing or embroidery machine, comprising the steps of:

replacing the machine's needle by attaching a pressing tool to the machine's needle bar;

attaching a contact point, a spring, and an arm to a presser foot of the machine;

replacing a needle plate of the machine with a perforator plate and waste holder;

placing a template medium on a work surface of the machine; and operating the machine using software that reads a user-specified pattern or motif outline for filling stones in vector form.

20. The method of claim 19, wherein the software determines placement of each stone on a pattern according to a user-selected technique, including outline shape, rectangle fill, circular fill, contour fill, shape fit fill, single line, and line fit.

* * * * *